US008780097B2

(12) United States Patent
Xu et al.

(10) Patent No.: US 8,780,097 B2
(45) Date of Patent: Jul. 15, 2014

(54) NEWTON RING MURA DETECTION SYSTEM

(75) Inventors: Xinyu Xu, Vancouver, WA (US); Xiao-fan Feng, Camas, WA (US); Chang Yuan, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 309 days.

(21) Appl. No.: 13/277,953

(22) Filed: Oct. 20, 2011

(65) Prior Publication Data

US 2013/0100089 A1 Apr. 25, 2013

(51) Int. Cl.
*G09G 5/00* (2006.01)

(52) U.S. Cl.
USPC ..... 345/204; 345/596; 348/92

(58) Field of Classification Search
CPC ..... G09G 3/006; G09G 2320/0233; G09G 2320/0238; G09G 2354/00; G09G 2360/16
USPC ..... 345/38, 50–54, 60, 64, 87–104; 348/192; 352/152
See application file for complete search history.

(56) References Cited

U.S. PATENT DOCUMENTS

| | | | | |
|---|---|---|---|---|
| 5,917,935 | A * | 6/1999 | Hawthorne et al. | 382/149 |
| 6,243,059 | B1 * | 6/2001 | Greene et al. | 345/88 |
| 7,538,867 | B2 | 5/2009 | Murai | |
| 2007/0126975 | A1 * | 6/2007 | Choi et al. | 349/192 |
| 2009/0028423 | A1 * | 1/2009 | Sandstrom et al. | 382/149 |
| 2009/0175530 | A1 * | 7/2009 | Sjostrom et al. | 382/152 |
| 2010/0104173 | A1 * | 4/2010 | Yoshida et al. | 382/145 |
| 2010/0148702 | A1 * | 6/2010 | Shen | 315/309 |
| 2010/0157044 | A1 * | 6/2010 | Mori et al. | 348/92 |
| 2011/0007090 | A1 * | 1/2011 | Chung et al. | 345/596 |

FOREIGN PATENT DOCUMENTS

| | | | |
|---|---|---|---|
| WO | 2008106015 | A2 | 9/2008 |
| WO | 2008129421 | A1 | 10/2008 |

* cited by examiner

*Primary Examiner* — Amare Mengistu
*Assistant Examiner* — Vinh Lam
(74) *Attorney, Agent, or Firm* — Chernoff Vilhauer McClung & Stenzel, LLP

(57) ABSTRACT

A system for detecting newton ring mura on a display includes sensing an image of the display with an image capture device and determining a border boundary of an illuminated portion of the display. The image is spatially filtered as defined by the border boundary using a filter that reduces sensor noise and a grid pattern of the display. The spatially filtered image is processed to determine if a region proximate a pixel location is a potential newton ring mura defect and characterizing the potential newton ring mura defects to remove at least one of the potential newton ring mura defects.

18 Claims, 8 Drawing Sheets

NEWTON RING MURA DETECTION SYSTEM

CROSS-REFERENCE TO RELATED APPLICATIONS

None.

BACKGROUND OF THE INVENTION

The present invention relates to a system for the detection of newton ring mura.

Flat panel displays, such as for example, a liquid crystal display, a plasma display, and an organic electroluminescent display, preferably display a uniform image on the display when provided a uniform grey level input. In the case of liquid crystal displays, mura type defects are generally caused by process flaws related to cell assembly, which affect the transmission of light through the display and are generally objectionable to viewers. The cyclical nature, randomness, and low contrast of such mura type defects makes accurate detection and classification difficult, especially for liquid crystal displays. With manufacturing variations in various components of a display, not all devices are capable of providing uniform display properties for the entire display area. Due to such irregularities, the display devices are visually inspected to determine whether or not they display a sufficiently uniform image.

As a general matter, one particular class of irregularity may be referred to as a newton ring mura which are generally a relatively small circular shaped non-uniformity. In general, the newton ring mura is a color based non-uniformity that appears as a ring.

One technique to detect such newton ring mura defects in a display is by manual visual inspection. An inspector looks at each display when presenting a uniform grey scale, and manually identifies and labels identified newton ring muras. This process of manual visual identification tends to be inconsistent and the identification heavily dependent on the skills and expertise of the inspectors. Also different inspectors take a different amount of time to inspect a display, together with a limited number of skilled inspectors, which limits the inspection of mass produced displays. In addition, inspectors tend to have variable performance over time due to fatigue.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
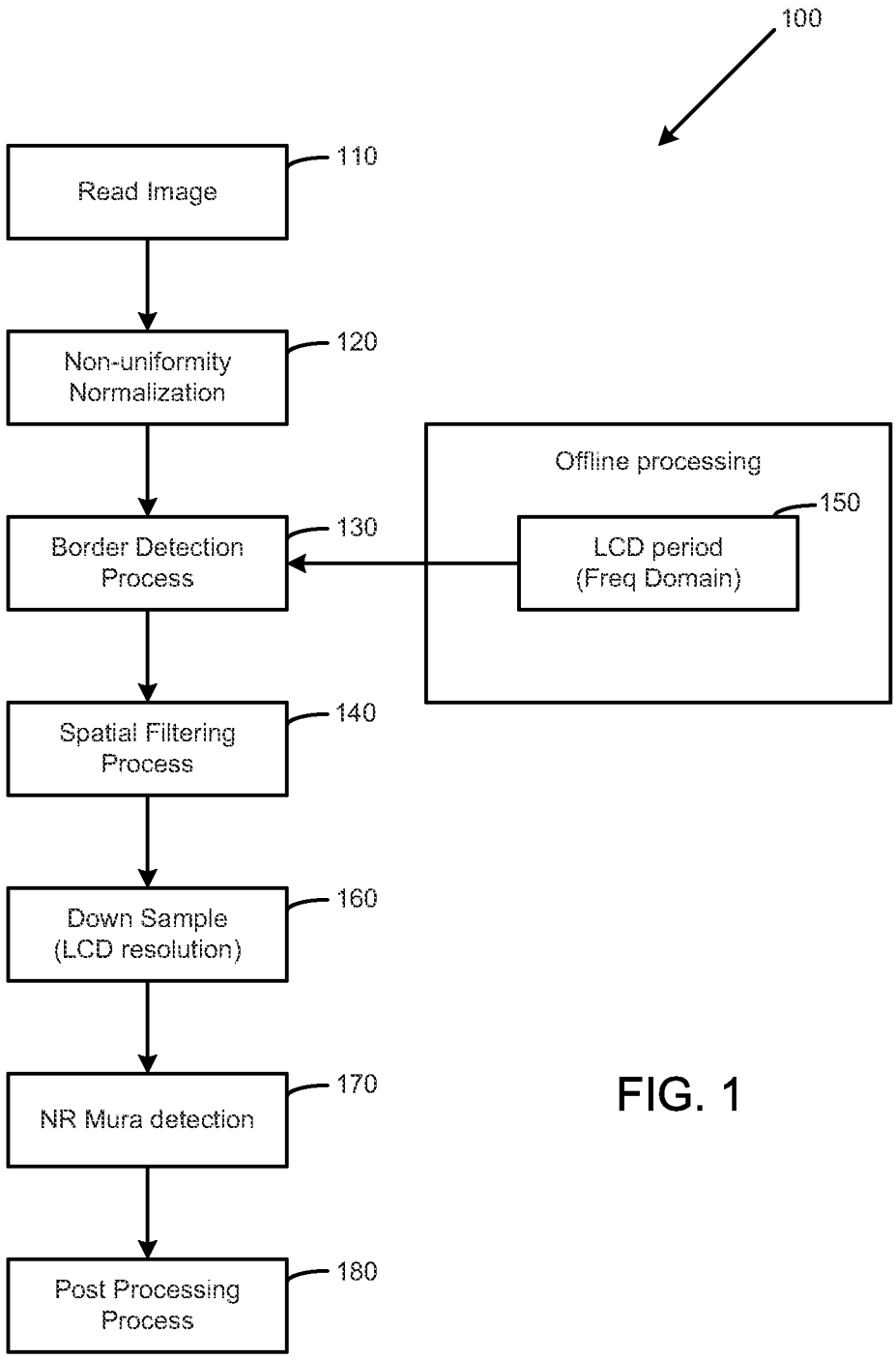
FIG. 1 illustrates a netwon mura detection system.

Referring to FIG. 1, a newton ring mura detection system 100 may include capturing an image of a display 110 using an image capture device. Any suitable image capture device may be used to obtain a sufficiently high resolution image of the display, with the display preferably presenting a uniform grey scale image on the display. The newton ring mura is generally a small circular speckle on the display, on the order of 10 pixels or less in diameter. In order to illuminate the display in a manner suitable for capturing an image, typically an external illumination source is also included to further illuminate the display. The result of capturing the image 110 with an externally illuminated display results in a non-uniform luminance distribution across the display, which may be corrected using a non-uniformity normalization process 120.

Figure 2:
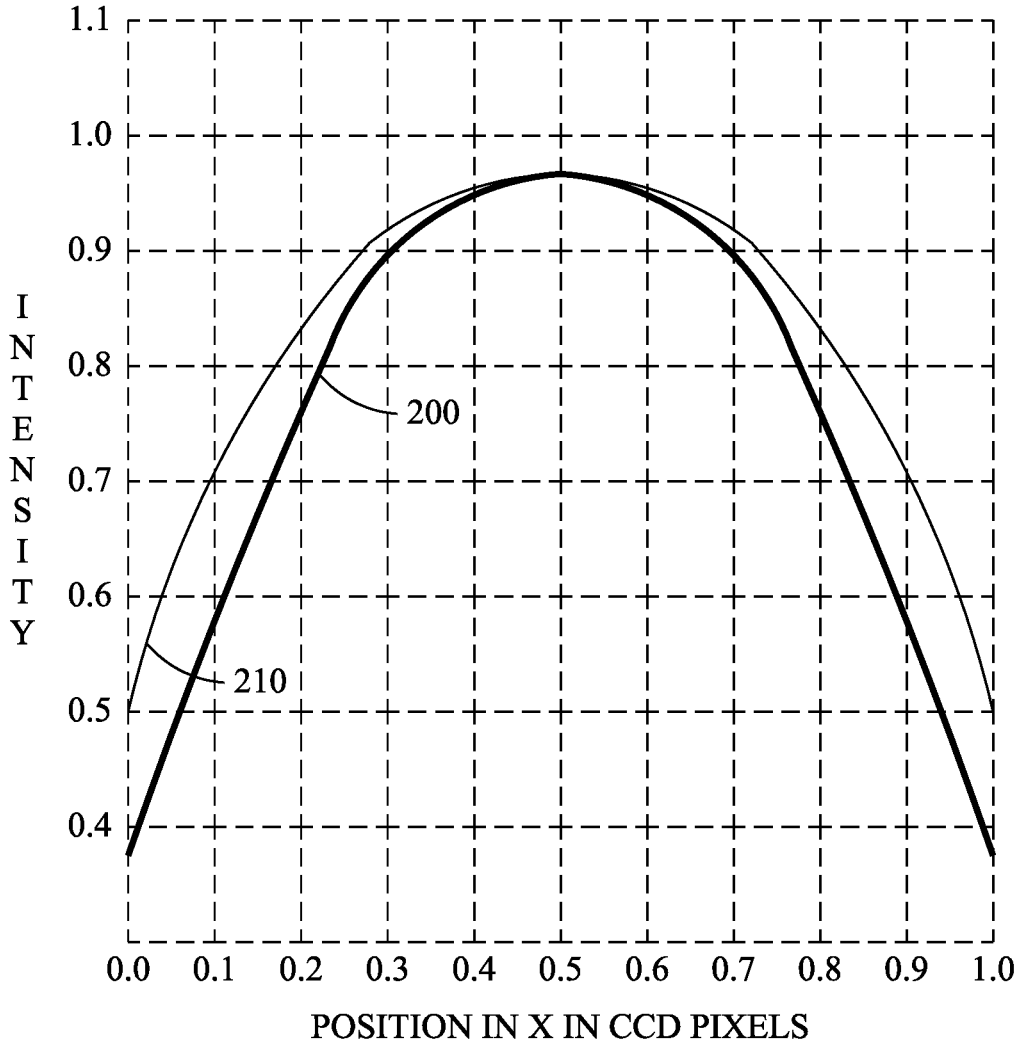
FIG. 2 illustrates non-uniformity correction.

Referring also to FIG. 2, for a centrally illuminated display the measured non-uniformity 200 across the display in a horizontal direction may be modified using the non-uniformity normalization 120 to adjust for the measured non-uniformity to provide a corrected horizontal uniform luminance 210. If desired, vertical non-uniformity across the display in a vertical direction may be modified using the non-uniformity normalization 120 to adjust for the measured non-uniformity to provide a corrected vertical uniform luminance.

The detection of the newton ring mura is generally done in a frequency based domain, as opposed to a spatial based domain. With the detection being done in a frequency based domain, the border boundary of the illuminated portion of the display tends to have a high frequency response. To reduce the likelihood of false positives a border detection process 130 may be used to identify and remove the border portion of the display so that only the illuminated region of the display is used for newton ring mura detection.

Figure 3:
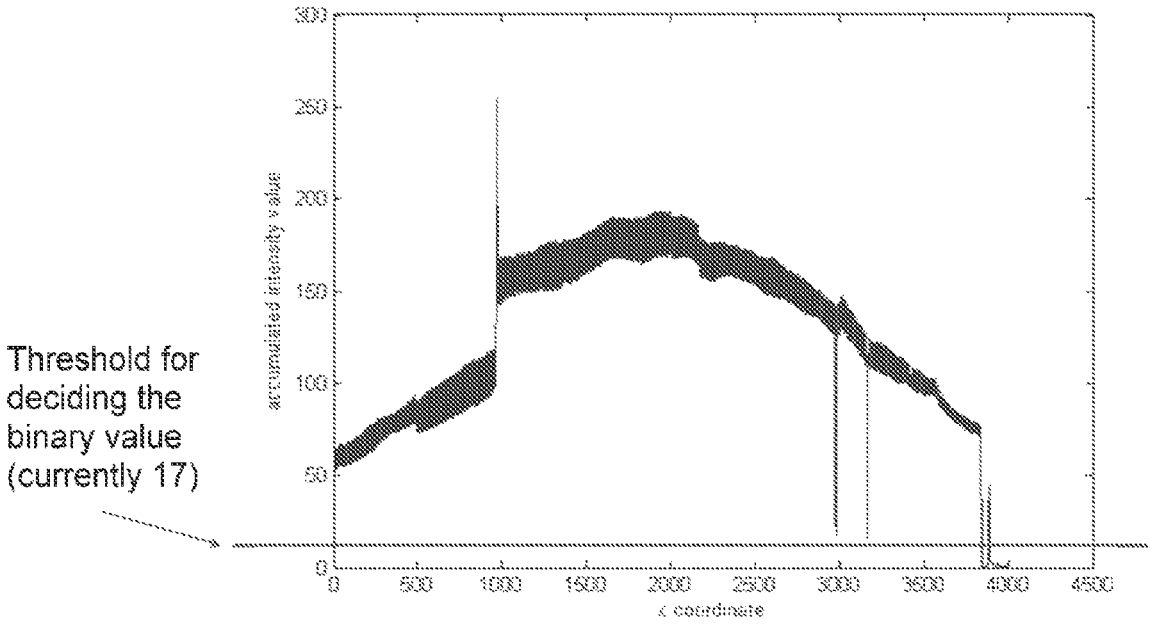
FIG. 3 illustrates a smoothed intensity value computed along the vertical direction from a stripe.
Figure 4:
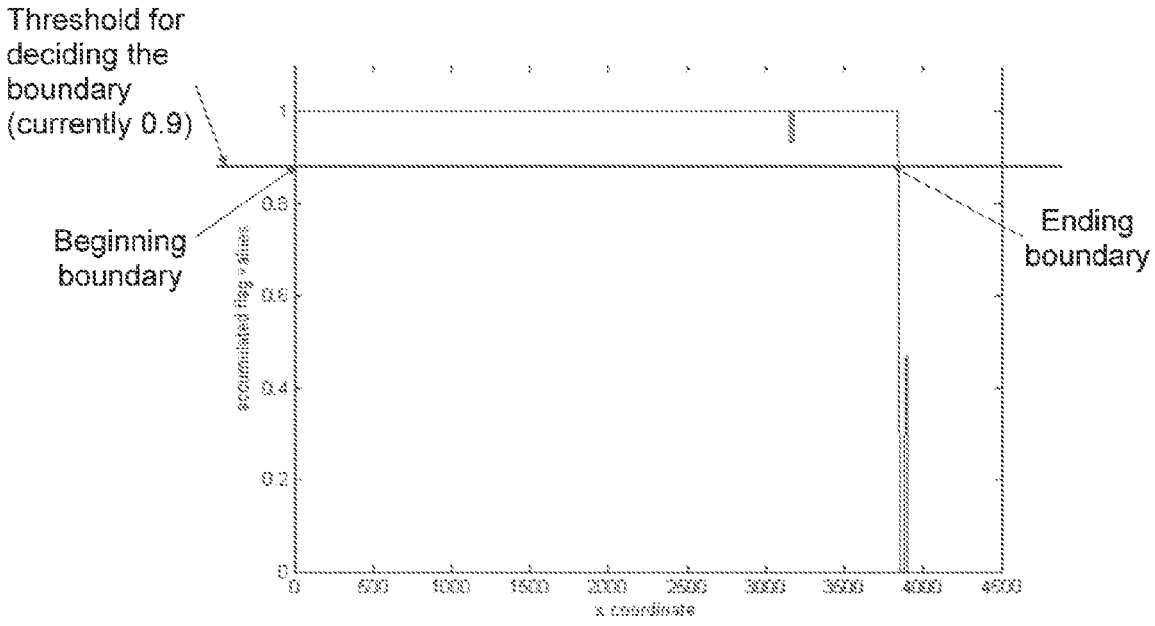
FIG. 4 illustrates a smoothed binary value.

One technique to identify the border region is to identify a wide and relatively bright segment along the horizontal direction in the image, and to identify a wide and relatively bright segment along the vertical direction in the image. Referring also to FIG. 3, one technique to detect the horizontal boundaries is to extract a 21 pixel wide horizontal stripe across the center of the image. The intensity value of the horizontal stripe is averaged along the vertical direction and the resulting average values are smoothed within a 15 pixel wide window. The resulting set of intensity values are compared to a threshold (e.g., such as 17) to generate a binary value for each pixel, such as 1 for a potential edge and otherwise 0. Referring also to FIG. 4, then the first pixel out from the center region in both directions with its binary value greater than a threshold, such as 0.9, is selected as the respective horizontal boundary. This boundary technique tends to ignore weaker vertical boundaries that may be a defect within the display, while identifying stronger vertical boundaries corresponding to a border region.

One technique to detect the vertical boundaries is to extract a 21 pixel wide vertical stripe across the center of the image. The intensity value of the vertical stripe is averaged along the horizontal direction and the resulting average values are smoothed within a 15 pixel wide window. The resulting set of intensity values are compared to a threshold (e.g., such as 17) to generate a binary value for each pixel, such as 1 for a potential edge and otherwise 0. Then the first pixel out from the center region in both directions with its binary value greater than a threshold, such as 0.9, is selected as the respective vertical boundary. This boundary technique tends to ignore weaker horizontal boundaries that may be a defect within the display, while identifying the stronger horizontal boundaries corresponding to a border region.

With the border regions identified by the border detection process 130, a spatial filtering process 140 may be applied to normalized image to remove the noise, which may include the grid pattern of the liquid crystal display and noise from the sensor (e.g., image capture device). The spatial filtering process 140 may be characterized as follows:

LCD(ƒ)=S(ƒ)T(ƒ)+N'(ƒ), where LCD(ƒ) represents the captured spectra, S(ƒ) represents the defects, T(ƒ) represents the camera transfer function, and N'(ƒ) represents generalized noise including LCD grid noise and sensor noise. The characterization and removal of the LCD grid noise results in improved subsequent identification of newton ring mura. A LCD period 150 estimates the grid pattern noise using a suitable filter, such as a Wiener filter, which minimizes the mean square error. The Wiener filter may be as follows:

$$g(f) = \frac{T^*(f)S(f)}{|T(f)|^2 S(f) + N(f)}$$

where S(ƒ) is the mean signal spectra, and T*(ƒ) is the conjugate of the image capture transfer function. The equation may be rearranged as follows:

$$g(f) = \frac{1}{T(f)}\left[\frac{|T(f)|^2}{|T(f)|^2 + \frac{N'(f)}{S(f)}}\right] = \frac{1}{T(f)}\left[\frac{|T(f)|^2}{|T(f)|^2 + \frac{1}{SNR(f)}}\right]$$

If the signal to noise ratio (SNR) at ƒ is very high, then N(ƒ)/S(ƒ)→0, where g(ƒ) is the inverse filter or de-convolution filter. If the SNR is low, then g(ƒ)→0. Accordingly, the filter will recover lost spatial frequencies if the SNR is high, and block spatial frequencies if the SNR is low.

Based upon the characterization that (1) N(ƒ)→∞ at the spectra peaks, and g(ƒ)→0 at these peaks; and (2) the signal spectrum is a sine-square function, and T(ƒ)=1, then the equation may be characterized as follows:

$$g(f) = \sin c(f)^2 \begin{cases} 1 - e^{-\frac{(f-fp)^2}{2\sigma^2}} & \text{peaks} \\ 1 & \text{otherwise} \end{cases}$$

where peaks is the LCD grid pattern, and otherwise is not the LCD grid pattern.

The spatial filtering process 140 applies the filter to remove (or otherwise reduces) the sensor noise and the LCD grid pattern noise. The spatial filtering process 140 may likewise remove other types of noise, as desired.

After the spatial filtering process 140 the image may be down sampled to the LCD resolution 160. The down sampled image reduces the computational requirements of the system. The down sampled image may be processed to detect newton ring mura 170.

Figure 5:
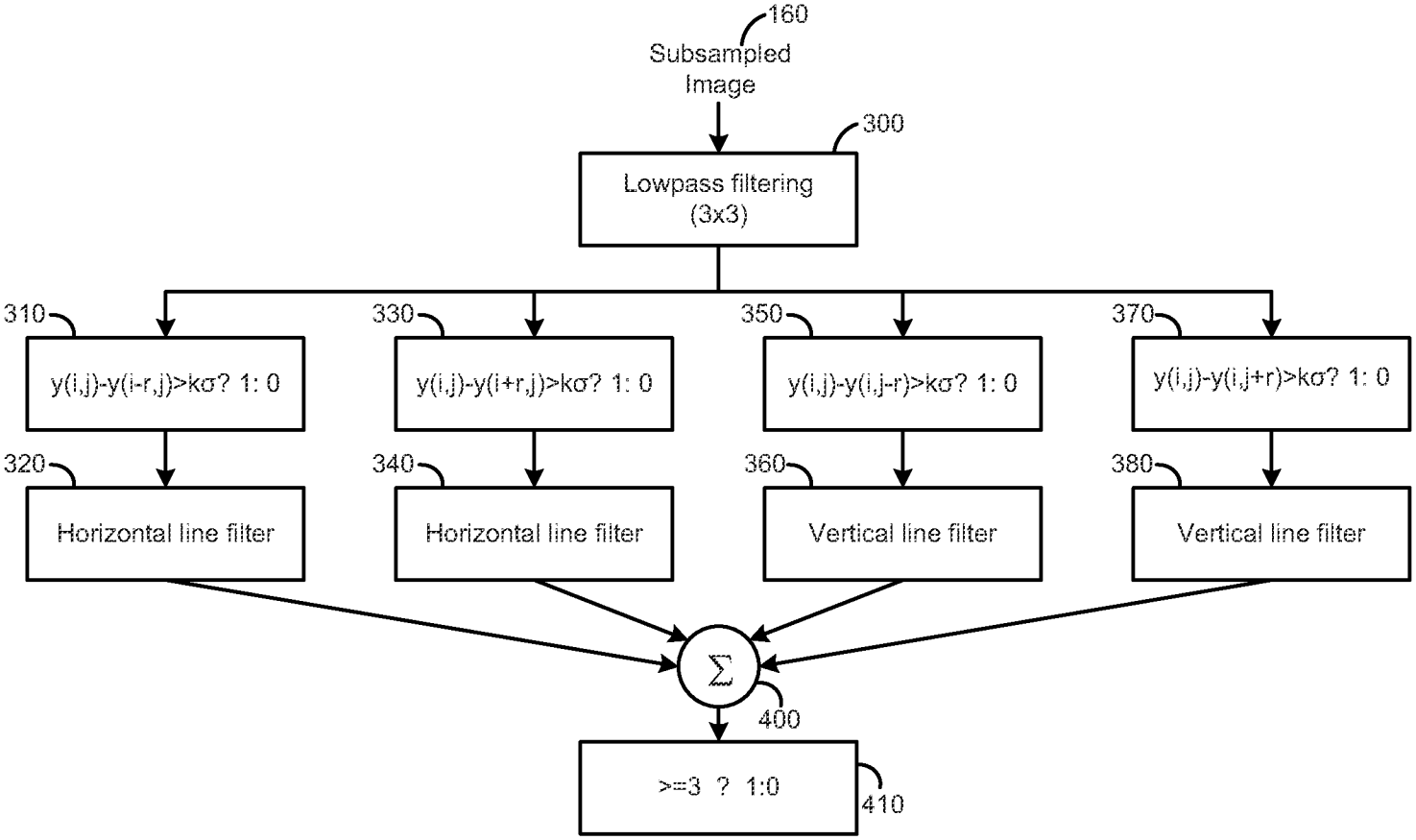
FIG. 5 illustrates a newton mura detection process.

Referring to FIG. 5, the sub-sampled image 160 may be low pass filtered 300, if desired. A top characterization 310 determines if a sufficient difference exists between an upper pixel distant by a distance of r from the subject pixel y(i,j). If a sufficient difference exists it is assigned a value of 1, otherwise it is assigned a value of 0. A horizontal line filter 320 detects and removes line based defects from above the subject pixel y(i,j) as being falsely detected as a newton ring mura defect. A bottom characterization 330 determines if a sufficient difference exists between a bottom pixel distant by a distance of r from the subject pixel y(i,j). If a sufficient difference exists it is assigned a value of 1, otherwise it is assigned a value of 0. A horizontal line filter 340 detects and removes line based defects from below the subject pixel y(i,j) as being falsely detected as a newton ring mura defect. A left characterization 350 determines if a sufficient difference exists between a left pixel distant by a distance of r from the subject pixel y(i,j). If a sufficient difference exists it is assigned a value of 1, otherwise it is assigned a value of 0. A vertical line filter 360 detects and removes line based defects from left of the subject pixel y(i,j) as being falsely detected as a newton ring mura defect. A right characterization 370 determines if a sufficient difference exists between a right pixel distant by a distance of r from the subject pixel y(i,j). If a sufficient difference exists it is assigned a value of 1, otherwise it is assigned a value of 0. A vertical line filter 380 detects and removes line based defects from right of the subject pixel y(i,j) as being falsely detected as a newton ring mura defect. The characterization process 310, 330, 350,370 determines a similarity measure around a pixel to determine if a sufficient difference occurs. For a newton ring mura defect on a grey level background, it is characterized generally as a small ring defect of sufficient non-uniformity.

By the selection of r, the detect newton ring mura 170 may determine using a summation process 400 whether there exists a sufficient change between a subject pixel and other pixels a selected distance away from the subject pixel. A masking process 410 determines that if the pixels do not sufficiently change, then it is unlikely that a newton ring mura defect exists at the subject pixel y(i,j) location. For example, the masking process 410 may determine that if only one or two of the pixel directions have sufficient change, then it is unlikely that a newton ring mura defect exists at the subject pixel y(i,j) location. For example, the masking process 410 may determine that if three and/or four of the pixel directions have sufficient change, then it is likely that a newton ring mura defect exists at the subject pixel y(i,j) location.

While the newton ring mura detection process 170 may determine likely locations of such a defect, a post processing process 180 may be used to remove at least some false positives and otherwise further characterize the potential newton ring mura.

Figure 6:
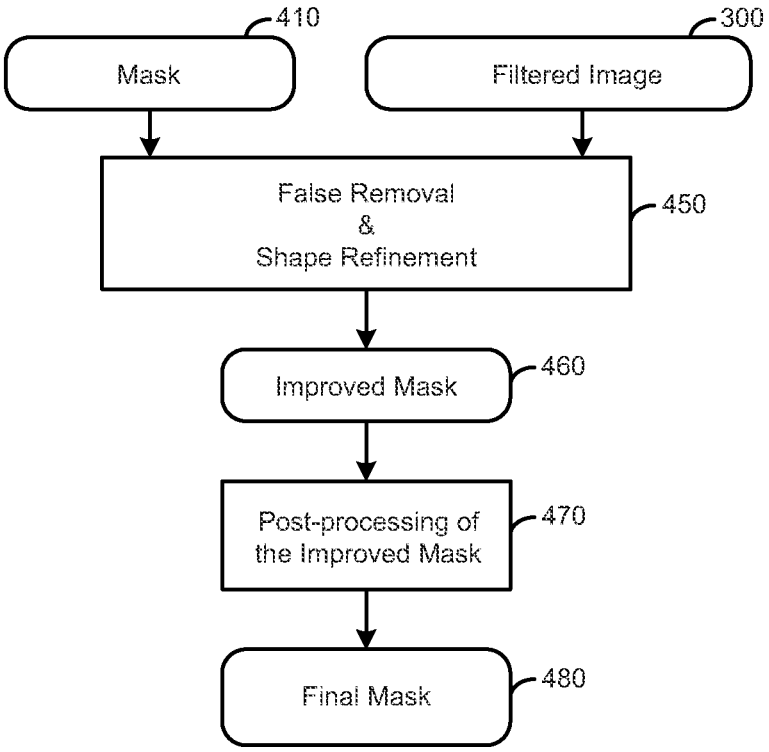
FIG. 6 illustrates false newton ring mura removal including a refinement process and a post-processing process.

Referring to FIG. 6, the post processing process 180 may receive the mask 410 and the filtered image 300. Based upon the mask 410 and the filtered image 300 the post processing process 180 may perform a false removal and shape refinement process 450 of the potential newton rings. The result of the refinement process 450 is an improved mask 460. The improved mask 460 may be used by a post-processing of improved mask process 470. The result of the post-processing of improved mask process 470 provides a final mask 480.

Figure 7:
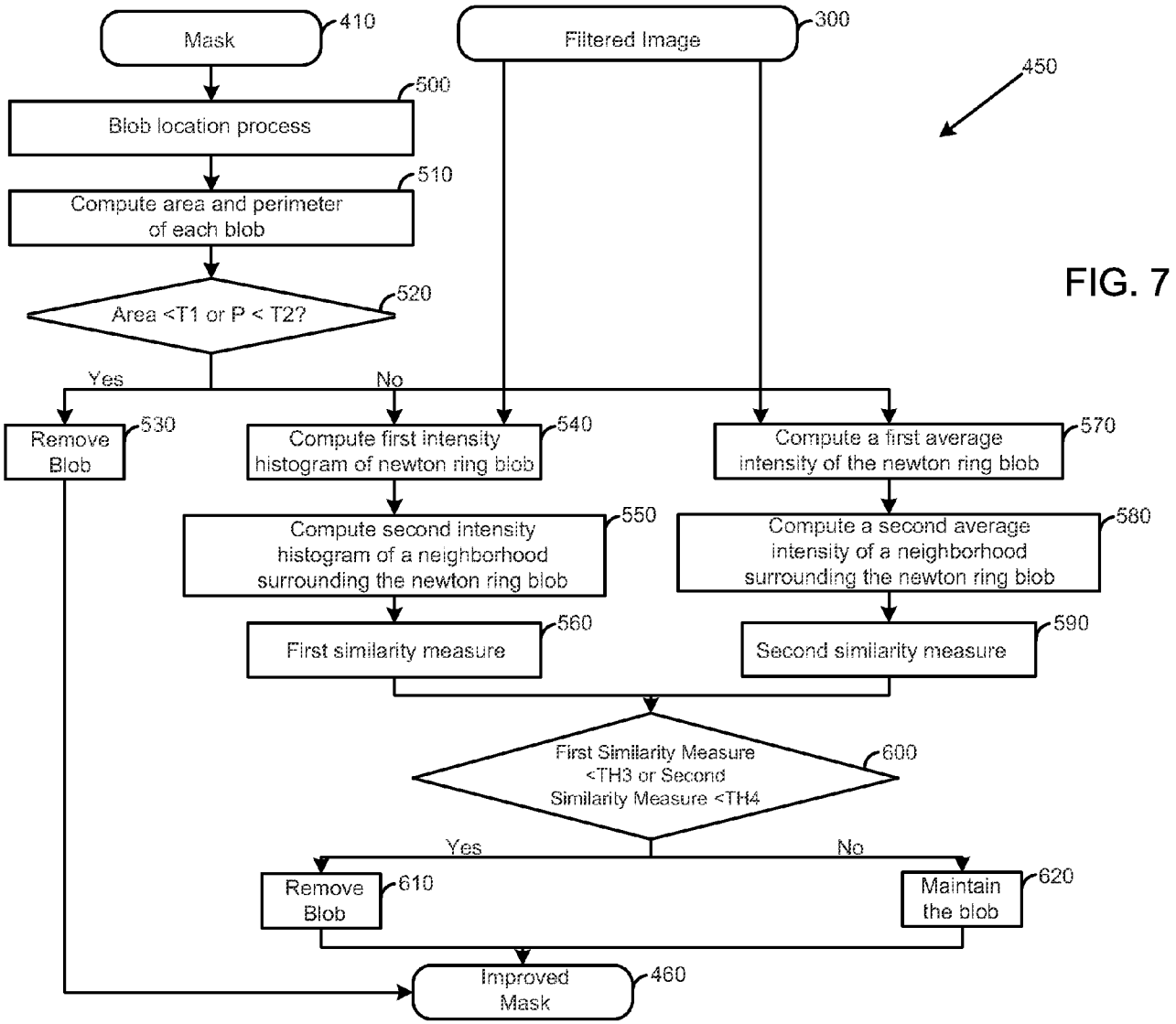
FIG. 7 illustrates a refinement process.

Referring to FIG. 7, the false removal and shape refinement process 450 includes using a combination of shape and intensity characteristics to determine whether a potential newton ring feature is a false positive, in which case the improved mask 460 is modified to remove such false positives. A blob location process 500 determines the location of each blob (i.e. group of samples) in the mask 410. The area and perimeter of each blob is computed 510 for each blob identified by the blob location process 500. If the area is less than a threshold T1 or the perimeter is less than a threshold T2 520, then the refinement process 450 characterizes the identified blob as not a newton ring, and removes the blob 530 from the mask 410, thereby determining the improved mask 460.

If the area is not less than a threshold T1 and the perimeter is not less than a threshold T2 520, then the refinement process 450 may compute a first intensity histogram of the newton ring blob 540 based upon the filtered image 300. The refinement process 450 may compute a second intensity histogram of a neighborhood surrounding the newton ring blob 550. In this manner, the refinement process 450 has determined a characteristic of the blob itself (e.g., the first intensity histogram) and a characteristic of the neighborhood surrounding the blob itself (e.g., the second intensity histogram) which provides characteristics of the area of interest. The first intensity histogram and the second intensity histogram are compared with one another 560 to determine a first similarity measure, such as using a Bhattacharyya distance measure.

If the area is not less than a threshold T1 and the perimeter is not less than a threshold T2 520, then the refinement process 450 may compute a first average intensity of the newton ring blob 570 based upon the filtered image 300. The refinement process 450 may compute a second average intensity of a neighborhood surrounding the newton ring blob 580. In this manner, the refinement process 450 determines a characteristic of the blob itself (e.g., the first average intensity) and a characteristic of the neighborhood surrounding the blob itself (e.g., the second average intensity) which provides characteristics of the area of interest. A second similarity measure 590 of the first average intensity and the second average intensity may be determined, such as determining the absolute value of the difference between the first average intensity and the second average intensity.

A comparison 600 is made to determine if the first similarity measure 560 is less than a third threshold TH3 or if the second similarity measure 590 is less than a fourth threshold TH4. In the case that the comparison determines that the first similarity measure 560 is sufficiently small or the second similarity measure is sufficiently small 590, then the refinement process 450 characterizes the identified blob as not a newton ring, and removes the blob 610 from the mask 410, thereby determining the improved mask 460. In the case that the comparison determines that the first similarity measure 560 is not sufficiently small and the second similarity measure is not sufficiently small 590, then the refinement process 450 characterizes the identified blob as a newton ring, and maintain the blob 620 in the mask 410, thereby determining the improved mask 460.

Figure 8:
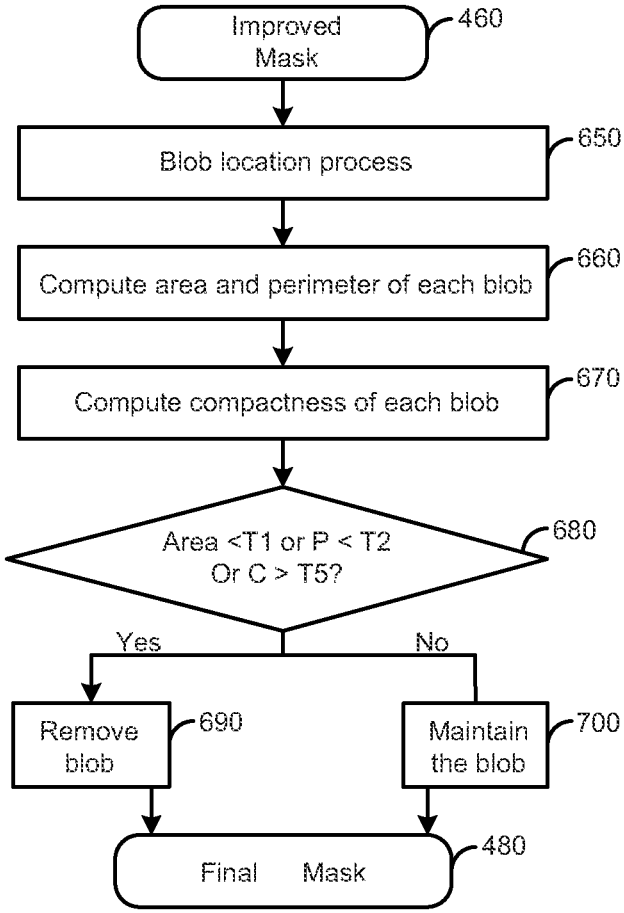
FIG. 8 illustrates a post-processing process.

Referring again to FIG. 6, the post-processing of the improved mask 470 receives the improved mask 460. Referring to FIG. 8, a blob location process 650 determines the location of each remaining blob (i.e. group of samples) in the improved mask 460. The area and perimeter of each blob is computed 660 for each blob identified by the blob location process 650. The compactness of each blob is also computed 670. If the area is less than a threshold T1 or the perimeter is less than a threshold T2 or the compactness is greater than a threshold T5 680, then the post processing of the improved mask process 470 characterizes the identified blob as not a newton ring, and removes the blob 690 from the mask 470, thereby determining the final mask 460.

If the area is greater than a threshold T1 and the perimeter is greater than a threshold T2 and the compactness is greater than a threshold T5 680, then the post processing of the improved mask process 470 characterizes the identified blob as a newton ring, and maintains the blob 700 in the mask 470, thereby determining the final mask 460. The resulting final mask 460 may be used for any suitable process, such as for example, firmware updates to reduce the artifacts, process control to modify the manufacturing process to reduce the artifacts, and modification of the display to reduce the artifacts.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A method for detecting newton ring mura on a display comprising:

(a) sensing an image of said display with an image capture device;

(b) determining a border boundary of an illuminated portion of said display;

(c) spatially filtering said image, that includes sensor noise and grid pattern noise, as defined by said border boundary using a filter that reduces sensor noise and a grid pattern of said display where said filter is not further based upon contemporaneously sensing a reference image, where said filter includes a function that jointly evaluates said sensor noise and said grid pattern noise of said display;

(d) processing said spatially filtered image to determine if a region proximate a pixel location is a potential newton ring mura defect;

(e) characterizing said potential newton ring mura defects to remove at least one said potential newton ring mura defect.

2. The method of claim 1 wherein a uniform grey scale image is provided to said display for being said sensed.

3. The method of claim 1 further comprising normalizing said sensed image to reduce the effects of non-uniform external illumination to said display.

4. The method of claim 3 wherein said normalizing is in a horizontal direction.

5. The method of claim 4 wherein said normalizing is in a vertical direction.

6. A method for detecting newton ring mura on a display comprising:

(a) sensing an image of said display with an image capture device;

(b) determining a border boundary of an illuminated portion of said display;

(c) spatially filtering said image as defined by said border boundary using a filter that reduces sensor noise and a grid pattern of said display;

(d) processing said spatially filtered image to determine if a region proximate a pixel location is a potential newton ring mura defect;

(e) characterizing said potential newton ring mura defects to remove at least one said potential newton ring mura defect;

(f) wherein said characterizing the relationship between mura defect and generalized noise with $LCD(f)=S(f)T(f)+N'(f)$, where mura defect is the signal that algorithm targets to find, and the panel grid pattern is modeled as noise, where $LCD(f)$ represents the captured spectra, $S(f)$ represents the defects, $T(f)$ represents the camera transfer function, and $N'(f)$ represents generalized noise including LCD grid noise and sensor noise.

7. The method of claim 1 wherein the grid pattern noise is removed by a Wiener filter.

8. The method of claim 1 wherein said determining said border boundary is performed in a frequency based domain.

9. The method of claim 1 wherein said border boundary is based upon a horizontal region across said display.

10. The method of claim 1 wherein said border boundary is based upon a vertical region across said display.

11. The method of claim 1 wherein determining said border boundary generally ignores weaker boundaries while identifying stronger boundaries corresponding to said border boundary.

12. The method of claim 1 wherein said processing said spatially filtered image includes determining whether sufficient differences between said pixel and a sufficient number of proximate pixels.

13. The method of claim 1 wherein said determining whether sufficient differences between said pixel and said sufficient number of proximate pixels includes a left direction, a right direction, an upper direction, and a lower direction.

14. The method of claim 1 wherein said characterizing includes a histogram of said potential newton ring mura defect.

15. The method of claim 12 wherein said characterizing includes a histogram of a region proximate said potential newton ring mura defect.

16. The method of claim 1 wherein said characterizing includes an area of said potential newton ring mura defect.

17. The method of claim 1 wherein said characterizing includes a perimeter of said potential newton ring mura defect.

18. The method of claim 1 wherein said characterizing includes a compactness of said potential newton ring mura defect.

* * * * *